United States Patent [19]

Usami et al.

[11] Patent Number: 4,999,333

[45] Date of Patent: Mar. 12, 1991

[54] HEAT SENSITIVE RECORDING MATERIAL

[75] Inventors: Toshimasa Usami; Seiji Hatakeyama; Akihiro Shimomura; Ken Iwakura, all of Shizuoka, Japan

[73] Assignee: Fuji Photo Film Co., Ltd., Kanagawa, Japan

[21] Appl. No.: 252,615

[22] Filed: Oct. 3, 1988

[30] Foreign Application Priority Data

| | | | |
|---|---|---|---|
| Oct. 2, 1987 | [JP] | Japan | 62-250457 |
| Oct. 2, 1987 | [JP] | Japan | 62-250458 |
| Oct. 15, 1987 | [JP] | Japan | 62-260371 |
| Oct. 19, 1987 | [JP] | Japan | 62-264824 |
| Oct. 20, 1987 | [JP] | Japan | 62-265135 |

[51] Int. Cl.[5] ..... B41M 5/18

[52] U.S. Cl. ..... 503/209; 428/520; 503/212; 503/214; 503/216; 503/217; 503/221

[58] Field of Search ..... 503/214, 215, 208, 209, 503/210–213, 216, 217, 221, 225, 226; 427/150–152; 428/520

[56] References Cited

U.S. PATENT DOCUMENTS

| | | | |
|---|---|---|---|
| 4,269,729 | 5/1981 | Maruyama et al. | 503/215 |
| 4,729,983 | 3/1988 | Satake et al. | 503/211 |
| 4,840,933 | 6/1989 | Usami et al. . | |

FOREIGN PATENT DOCUMENTS

| | | | |
|---|---|---|---|
| 1152486 | 7/1986 | Japan | 503/215 |

*Primary Examiner*—Bruce H. Hess

*Attorney, Agent, or Firm*—Sughrue, Mion, Zinn, Macpeak & Seas

[57] ABSTRACT

A heat sensitive recording material which is comprised of a support having thereon at least a transparent heat sensitive layer excellent in freshness-keeping property is disclosed. The transparent heat sensitive layer is obtained by coating a solution obtained by mixing a microcapsule containing a colorless or light colored electron donating dye precursor with an emulsion prepared by dispersing a color developer dissolved in an organic solvent, which is slightly soluble or insoluble in water, into an aqueous solution containing both of a surface active agent and water soluble polymer. The stabilities of emulsion and heat sensitive layer are improved by using a partially saponified polyvinyl alcohol as the water soluble polymer and/or adding a metal salts of a salicylic acid derivatives into the coolor developer. A heat sensitivity of the heat sensitive recording material is improved by using a organic solvent having a boiling point lower than 150° C. alone as said organic solvent and/or using a special electron donating dye precursor. An antiscratch property of the heat sensitive layer is able to improve without lowering the transparency by adding a special fillers in the heat sensitive layer.

9 Claims, No Drawings

HEAT SENSITIVE RECORDING MATERIAL

FIELD OF THE INVENTION

The present invention relates to a heat sensitive recording material which is comprised of a support having thereon a transparent heat sensitive layer. More particularly, the present invention relates to a heat sensitive recording material which is not only improved in transparency but also excellent in freshness-keeping property.

BACKGROUND OF THE INVENTION

A heat sensitive recording method has many advantages in that (1) no particular developing step is required, (2) if paper is used as a support, a recording material prepared can have a quality akin to that of plain paper, (3) handling of a recording material used is easy, (4) images recorded has high color density, (5) this method can be embodied using a simple and cheap apparatus, (6) no noise is generated upon recording, and so on. Therefore, heat sensitive recording materials have recently enjoyed a markedly increasing demand, particularly in the fields of facsimile and printer, and have come to be used for many purposes.

With this background, it has come to be desired to develop transparent heat sensitive recording materials which enables direct recording with a thermal head in order to adapt them for multicolor development, or to make them usable for an overhead projector (hereafter it is written as OHP).

However, conventional transparent heat sensitive recording materials are so-called transparent heat sensitive films in which the film is brought into direct contact with an original and exposed to light, and thereby an infrared portion of the light is absorbed by image areas of the original to raise the temperature of the image areas, which results in color development of the heat sensitive film. Accordingly, they do not have heat sensitivity high enough to enable direct heat recording with a thermal head to be used in facsimile and the like.

In addition, a heat sensitive layer of heat sensitive recording materials of the kind which use a thermal head upon heat recording is in a devitrified condition, so a desired transparency cannot be achieved by merely coating such a layer on a transparent support.

As heat sensitive recording materials which can solve the above mentioned defects, we had suggested a new transparent heat sensitive recording material which can be prepared by using a combination of a colorless or light colored electron donating dye precursor and a color developer as color development system, wherein the former is microencapsulated and the latter is emulsified and dispersed under a certain condition, then both are mixed and coated on a support.

However, from the heat sensitive layer of above mentioned transparent heat sensitive recording material, the color developer is apt to come out to deposit. Therefore, the transparency of the heat sensitive recording material is lowered and an extent of it depends strongly on a stability of an emulsified dispersion which is utilized when the heat sensitive recording layer is coated and also depends on a kind of the color developer.

As a result of concentrating our energies on solving above mentioned defects, we have found that it is quite effective to use a partially saponified polyvinyl alcohol for a protective colloid which is used in the before mentioned emulsified dispersion, and/or to use a metal salt of salicylic acid derivative together with the color developer to prevent the deposition of the color developer from the heat sensitive layer, then we have completed the present invention.

SUMMARY OF THE INVENTION

Therefore, a first object of the present invention is to provide a heat sensitive recording material having a transparent heat sensitive layer which has excellent freshness-keeping property.

A second object of the present invention is to provide a heat sensitive recording material which can be used for an overhead projector and has high sensitivity.

Further, a third object of the present invention is to provide a method to improve a keeping property of a heat sensitive recording material having a transparent heat sensitive layer.

Above objects of the present invention were attained by a heat sensitive recording material which is comprised of a support having thereon a transparent heat sensitive layer prepared by coating a solution obtained by mixing a microcapsule containing an electron donating dye precursor with an emulsion prepared by dispersing a color developer (which may contain a metal salts of a salicylic acid derivatives) dissolved in an organic solvent slightly soluble or insoluble in water, into an aqueous solution containing both of a surface active agent and water soluble polymer comprised of a partially saponified polyvinyl alcohol on the support then drying the coat.

According to the present invention, stability of a coated film of a heat sensitive layer is remarkably improved. Therefore, a heat sensitive recording material having a transparent heat sensitive layer can be produced in good reproducibility and in good efficiency.

DETAILED DESCRIPTION OF THE INVENTION

Electron donating dye precursors to be employed in the present invention are selected properly from known colorless or light colored compounds of the kind which can develop their colors by donating an electron or accepting a proton of an acid or the like. These compounds have such a skeleton as that of lactone, lactam, sultone, spiropyran, ester, amide, etc., as a part of their structures, and these skeletons undergo ring-opening or bond cleavage upon contact with a color developer. Preferred examples of such compounds include triarylmethane compounds, diphenylmethane compounds, xanthene compounds, thiazine compounds, spiropyran compounds and so on.

Particularly preferred compounds are those represented by the following general formula:

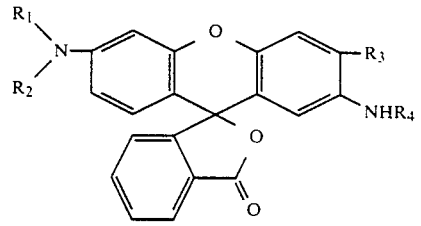

In the foregoing formula, $R_1$ represents an alkyl group containing 1 to 8 carbon atoms; $R_2$ represents an alkyl or alkoxyalkyl group containing 4 to 18 carbon atoms, or a tetrahydrofuryl group; $R_3$ represents a hydrogen atom, an alkyl group containing 1 to 15 carbon atoms, or a halogen atom; and $R_4$ represents a substituted or unsubstituted aryl group containing 6 to 20 carbon atoms. As substituent group for $R_4$, alkyl, alkoxy and halogenated alkyl groups containing 1 to 5 carbon atoms, and halogen atoms are preferred. Especially, from view points that a solubility to the aftermentioned organic solvent is excellent then a concentration of the dye precursor in a microcapsule is able to be high, therefore an image density at recording is heightened and heat sensitivity of a heat sensitive recording material becomes sufficient, it is desired to be selected methyl group for $R_3$ and phenyl group for $R_4$. Particularly, excellent result can be obtained when the combination of ethyl group for $R_1$ and a group having a branch, especially isobutyl group for $R_2$ is selected.

Microencapsulation of the above-described color former in the present invention can prevent generation of fog during production of a heat sensitive material and, at the same time, can improve a freshness keeping property of a heat sensitive material and a keeping property of the record formed. Therein, the image density at the time of recording can be heightened by properly selecting a material and a method for forming a microcapsule wall. A preferred amount of the color former used is 0.05 to 5.0 g per square meter.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pyrrolidone, polyvinyl alcohol, and so on. These macromolecular substances can be used in combination of two or more thereof in the present invention.

Of the above-cited macromolecular substances, polyurethane, polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 222716/84 (the term "OPI" as used herein means an "unexamined published application"), and so on can be referred to.

An organic solvent to constitute the above-described oil droplets can be properly selected from those used generally for pressure sensitive material.

Some of desirable oils are compounds represented by the following general formulae (I) to (III), triarylmethanes (such as tritoluylmethane, toluyldiphenylmethane), terphenyl compounds (such as terphenyl), alkylated diphenyl ethers (such as propyldiphenyl ether), hydrogenated terphenyl compounds (such as hexahydroterphenyl), diphenyl ethers, chlorinated paraffins and so on.

(I)

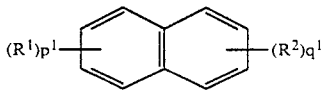

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less.

Preferred alkyl groups represented by $R^1$ and $R^2$ are those containing 1 to 8 carbon atoms.

(II)

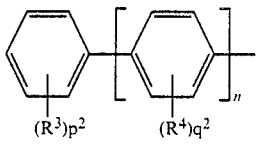

In the above formula, $R^3$ represents a hydrogen atom, or an alkyl group containing 1 to 12 carbon atoms; $R^4$ represents an alkyl group containing 1 to 12 carbon atoms; and n is 1 or 2.

$p^2$ and $q^2$ each represents an integer of 1 to 4. The total number of alkyl groups is 4 or less in case of $n=1$, while it is 6 or less in case of $n=2$.

(III)

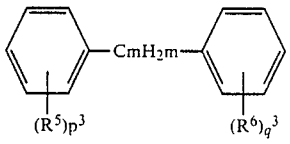

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (I) include dimethylnaphthalene, diethylnaphthalene, diisopropylnaphthalene, and the like.

Specific examples of the compounds represented by the formula (II) include dimethylbiphenyl, diethylbiphenyl, diisopropylbiphenyl, diisobutylbiphenyl, and the like.

Specific examples of the compounds represented by the formula (III) include 1-methyl-1-dimethylphenyl-1-phenylmethane, 1-ethyl-1-dimethylphenyl-1-phenylmethane, 1-propyl-1-dimethylphenyl-1-phenylmethane, and the like.

The above-cited oils can be used as a mixture of two or more thereof, or in combination with other oils.

Desirable microcapsules which are produced in the above-described manner are not those of the kind which are disrupted by heat or pressure, but those of the kind which have a microcapsule wall through which reactive substances present inside and outside the individual microcapsules respectively can permeate at high temperature to react with each other.

Multicolored neutral tints can be effected by preparing some kinds of microcapsules having walls differing in glass transition point through proper selection of wall materials, and optional addition of glass transition point controlling agents (e.g., plasticizers described in Japanese Patent Application (OPI) No. 119862/85) to the wall materials, respectively, and further by combining selectively colorless electron donating dye precursors differing in hue with their respective color developers. Therefore, the present invention is not limited to a monochromatic heat sensitive recording material but can be applied to a two-color or multicolor heat sensitive recording material and a heat sensitive recording material suitable for recording of graded image.

In addition, a photodiscoloration inhibitor as described, e.g., in Japanese Patent Application (OPI) Nos. 125470/85, 125471/85 and 125472/85 can be added, if desired.

Color developers to be employed in the present invention, which undergo the color development reaction with electron donating dye precursors when heated, can be those selected properly from known color developers. For instance, suitable examples of color developers to be combined with leuco dyes include phenol compounds, sulfur-contained phenolic compounds, carboxylic acid compounds, sulfon compounds, urea or thiourea compounds, and so on. Details of the color developers are described, e.g., in "Kami Pulp Gijutsu Times," pp. 49–54, and pp. 65–70 (1985). Of such color developers, those having melting points of 50° to 250° C., particularly phenols and organic acids which have melting points of 60° to 200° C. and are hardly soluble in water, are preferred over others. Combined use of two or more of color developers is desirable because of increase in solubility. Especially, it is desired to use a combination of free phenolic compounds and metal salts of salicylic acid as a color developer in the present invention to obtain a transparent heat sensitive layer which is excellent in freshness keeping property.

The free phenolic compound means a phenolic compound which does not form metal salt.

The free phenolic compound preferred particularly in the present invention are represented by the following general formulae (IV) to (VII):

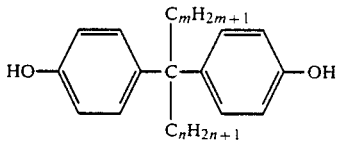

(IV)

m = 0–2, n = 2–11

$R_1$ is an alkyl group, an aryl group, an aryloxyalkyl group, or an aralkyl group. In particular, methyl group, ethyl group and butyl group are preferred as $R_1$.

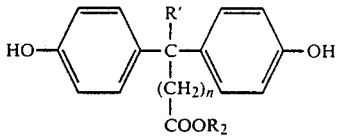

(VI)

R' is a hydrogen atom or methyl group and n is 0–2.

$R_2$ is an alkyl group. In particular, butyl group, pentyl group, heptyl group, and octyl group are preferred as $R_2$.

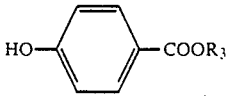

(VII)

$R_3$ is an alkyl group, or an aryloxyalkyl group. Examples of above mentioned phenolic compounds are described, e.g., in "Kami Pulp Times, pp. 49–54, and pp. 65–70 (1985)".

In the present invention, such a color developer is used in a form of emulsified dispersion. The dispersion can be prepared by dissolving color developers in an organic solvent slightly soluble or insoluble in water, and mixing the resulting solution with an aqueous phase which contains a surface active agent and a water-soluble high polymer as a protective colloid to emulsify and to disperse the solution in the aqueous phase.

In this case, although the reason is not always elucidated, by adding a certain amount of a metal salt of salicylic acid derivatives as a part of color developer, it is able to prevent a deposition of the color developers from a heat sensitive layer prepared by coating a coating solution on a support since stability of the heat sensitive layer is improved.

Above mentioned salicylic acid can be represented by the following general formula;

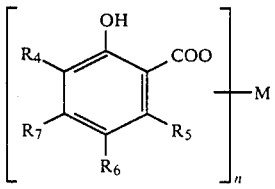

$R_4$, $R_5$, $R_6$ and $R_7$ represent hydrogen atom, halogen atom, amino group which may have a substituent, carboxyl group which may have a substituent, carbamoyl group which may have a substituent, hydroxy group which may have a substituent, sulfonyl group which may have a substituent, alkyl group and aryl group. Two adjacent groups among $R_4$–$R_7$ may be bonded each other to form a ring.

M represents n-valent metal atom and n represents integer of 1–3.

Wherein, the alkyl group represents saturated or unsaturated alkyl group or cycloalkyl group and it may have substituents such as aryl group, alkoxy group, aryloxy group, halogen atom, acylamino group, aminocarbonyl group or cyano group and so on. On the other hand, the aryl group represents phenyl group, naphthyl group or heterocyclic aromatic group and it may have a substituent such as alkyl group, alkoxy group, aryloxy group, halogen atom, nitro group, cyano group, substituted carbamoyl group, substituted sulfamoyl group, substituted oxysulfonyl group, thioalkoxy group, arylsulfonyl group or phenyl group and so on.

Specific examples of the compounds are a salicylic acid and mono substituted derivatives thereof such as a salicylic acid, an ortho-cresotinic acid, a paracresotinic acid, 3-ethylsalicylic acid, 4-ethylsalicylic acid, 3-isopropyl salicylic acid, 4-isopropyl salicylic acid, 5-isopropyl salicylic acid, 3-tert-butyl salicylic acid, 5-tert-butyl salicylic acid, 3-cyclohexyl salicylic acid, 5-cyclohexyl salicylic acid, 3-phenyl salicylic acid, 5-phenyl salicylic acid, 3-benzyl salicylic acid, 5-tert-octyl salicylic acid, 3-(α-methylbenzyl)salicylic acid, 5-(α-methylbenzyl)salicylic acid, 5-nonyl salicylic acid, 5-(α,α-dimethylbenzyl)salicylic acid, 5-chlorosalicylic acid, 5-butoxy salicylic acid, 5-octoxy salicylic acid, 3,5-dichloro salicylic acid, 3-chloro-5-tert-butyl salicylic acid, 3-chloro-5-tert-amyl salicylic acid, 3-chloro-5-tert-octyl salicylic acid, 3-chloro-5-(α,α-dimethylbenzyl)salicylic acid, 3,5-dimethyl salicylic acid, 3-methyl-5-tert-butyl salicylic acid, 3-methyl-5-cyclohexyl salicylic acid, 3-methyl-5-tert-octyl salicylic acid, 3-methyl-5-(α-methylbenzyl)salicylic acid, 3-methyl-5-nonyl salicylic acid, 3-methyl-5-(α,α-dimethylbenzyl)salicylic acid, 3,5-di-isopropyl salicylic acid, 3,5-di-sec-butyl salicylic acid, 3-tert-butyl-5-chlorosalicylic acid, 3-tert-butyl-5-methyl salicylic acid, 3-tert-butyl-5-ethyl salicylic acid, 3,5-di-tert-butyl salicylic acid, 3-tert-butyl-5-cyclohexyl salicylic acid, 3-tert-butyl-5-phenyl salicylic acid, 3-tert-butyl-5-(4'-tert-butylphenyl) salicylic acid, 3-tert-amyl-5-chlorosalicylic acid, 3-tert-amyl-5-methyl salicylic acid, 3-tert-amyl-5-ethyl salicylic acid, 3,5-di-tert-amyl salicylic acid, 3-tert-amyl-5-cyclohexyl salicylic acid, 3-tert-amyl-5-phenylsalicylic acid, 3-tert-amyl-5-(1'-tert-amylphenyl) salicylic acid, 3-cyclohexyl-5-chlorosalicylic acid, 3-cyclohexyl-5-methyl salicylic acid, 3-cyclohexyl-5-ethyl salicylic acid, 3,5-cyclohexyl salicylic acid, 3-cyclohexyl-5-phenyl salicylic acid, 3-cyclohexyl-5-(1'-cyclohexylphenyl) salicylic acid, 3-phenyl-5-chlorosalicylic acid, 3-phenyl-5-isopropyl salicylic acid, 3-phenyl-5-tert-butyl salicylic acid, 3-phenyl-5-cyclohexyl salicylic acid, 3-phenyl-5-benzyl salicylic acid, 3-phenyl-5-tert-octyl salicylic acid, 3-phenyl-5-(α-methylbenzyl) salicylic acid, 3-phenyl-5-nonyl salicylic acid, 3-phenyl-5-(α,α-dimethylbenzyl) salicylic acid, 3-benzyl-5-chlorosalicylic acid, 3-benzyl-5-methyl salicylic acid, 3-benzyl-5-ethyl salicylic acid, 3-benzyl-5-cyclohexyl salicylic acid, 3-benzyl-5-phenyl salicylic acid, 3,5-di-benzyl salicylic acid, 3-benzyl-5-tert-octyl salicylic acid, 3-benzyl-5-nonyl salicylic acid, 3benzyl-5-(α,α-dimethylbenzyl) salicylic acid, 3-tert-octyl-5-chloro salicylic acid, 3-tert-octyl-5-methyl salicylic acid, 3-tert-octyl-5-ethyl salicylic acid, 3-tert-octyl-5-cyclohexyl salicylic acid, 3-tert-octyl-5-phenyl salicylic acid, 3,5-di-tert-octyl salicylic acid, 3-(α-methylbenzyl)-5-chlorosalicylic acid, 3-(α-methylbenzyl)-5-methyl salicylic acid, 3-(α-methylbenzyl-5-ethyl salicylic acid, 3-(α-methylbenzyl)-5-cyclohexyl salicylic acid, 3-(α-methylbenzyl)-5-phenyl salicylic acid, 3,5-di(α-methylbenzyl) salicylic acid, 3,5-di(α-tolylethyl) salicylic acid, 3-(α-methylbenzyl)-5-(α,α-dimethylbenzyl) salicylic acid, 3-(α-methylbenzyl)-5-(4'-(α-methylbenzyl)phenyl)salicylic acid, 3-nonyl-5-chlorosalicylic acid, 3-nonyl-5-methyl salicylic acid, 3-nonyl-5-ethyl salicylic acid, 3-nonyl-5-phenyl salicylic acid, 3,5-dinonyl salicylic acid, 3-(α,α-dimethylbenzyl)-5-chlorosalicylic acid, 3-(α,α-dimethylbenzyl)-5-methyl salicylic acid, 3-(α,α-dimethylbenzyl)-5-phenyl salicylic acid, 3-(α,α-dimethylbenzyl)-5-(α-methylbenzyl) salicylic acid, 3,5-di-(α,α-dimethylbenzyl) salicylic acid, 3-(4'-tert-butylphenyl)-5-tert-butyl) salicylic acid, 3-(4'-cyclohexylphenyl)-5-cyclohexyl salicylic acid, 3-(4'-(α,α-dimethylbenzyl)phenyl)-5-(α,α-dimethylbenzyl) salicylic acid, 4-methyl-5-cyclohexyl salicylic acid, 4-methyl-5-benzyl salicylic acid, 4-methyl-5-tert-octyl salicylic acid, 4-methyl-5-(α-methylbenzyl) salicylic acid, 4-methyl-5-nonyl salicylic acid, 4-methyl-5-(α,α-dimethylbenzyl) salicylic acid, 3,6-dimethyl salicylic acid, 3-tert-butyl-6-methyl salicylic acid, 3-tert-amyl-6-methyl salicylic acid, 3-cyclohexyl-6-methyl salicylic acid, 3-tert-octyl-6-methyl salicylic acid, 3-(α-methylbenzyl)-6-methyl salicylic acid, 3,6-diisopropyl salicylic acid, 3-tert-butyl-6-isopropyl salicylic acid, 3-tert-octyl-6-isopropyl salicylic acid, 3-(α,α-dimethylbenzyl)-6-isopropyl salicylic acid, 3-tert-butyl-6-phenyl salicylic acid, 3-tert-amyl-6-phenyl salicylic acid, 3-cyclohexyl-6-phenyl salicylic acid, 3-tert-octyl-6-phenyl salicylic acid, 3-(α-methylbenzyl)-6-phenyl salicylic acid, 3-(α,α-dimethylbenzyl)-6-phenyl salicylic acid, 4-pentadecyl salicylic acid, 4-decyloxy salicylic acid, 4-β-phenoxyethyloxy salicylic acid, 1-hydroxy-2-carboxy-4,7-di(α-methylbenzyl)naphthalene, 1-hydroxy-2-carboxy-4,7-di(α,α-dimethylbenzyl)naphthalene, 2-hydroxy-3-carboxy-6,8-di(α-methylbenzyl)naphthalene, 2-hydroxy-3-carboxy-6,8-di(α,α-dimethylbenzyl)-naphthalene, 5-(α,α-dimethyl-3'-carboxy-4'-hydroxybenzyl) salicylic acid, 5-(α,α-dimethyl-4'-hydroxybenzyl) salicylic acid, 3-(2'-hydroxy-3'-carboxy-5'-(α,α-dimethylbenzyl)phenoxy)-5-(α,α-dimethylbenzyl) salicylic acid, 3-(2'-hydroxy-3',5'-di(α,α-dimethylbenzyl)-phenoxy)-5-(α,α-dimethylbenzyl) salicylic acid, 3-(2'-hydroxy-3',5'-dicyclohexylphenoxy)-5-cyclohexyl salicylic acid, 5-(α-methylbenzyl)-α-methylbenzyl) salicylic acid and so on. Moreover, many aromatic salicylic acids which are difficult to describe in concrete chemical name like above are also useful in this invention. Some of these compounds are metal salts of e.g., a formaldehyde copolycondensation product of a salicylic acid derivative and phenols, an addition product of a propylene polymer with a salicylic acid derivative, an addition product of a isobutylene polymer with a salicylic acid derivative, a condensation product of a polycondensed benzylchloride with a salicylic acid derivative, an addition product of styrene polymer with a salicylic acid derivative, an addition product of α-methylstyrene polymer with a salicylic acid derivative, an addition product of aldehyde, keton or styrene with a salicylic acid derivative, an addition product of a compound having unsaturated bonds with a salicylic acid derivative etc.

Some of preferred metal atoms which are able to form above-described salts are zinc, aluminium and calcium, in particularly, zinc is the best.

In the present invention, these metal salts are used in an amount of 5–70 wt %, preferably 10–40 wt %, per total amount of color developers. If the amount of these metal salts are less than 5 wt %, stabilization of a coated film can not be expected, and if the amounts of those metal salts are more than 70 wt % coloring density becomes so low that obtained heat sensitive recording material can not be used in fact.

An organic solvent to be used for dissolving the color developers can be properly selected from known organic solvents slightly soluble or insoluble in water, in particular, esters having boiling point higher than 150° C. or before mentioned oils used for pressure sensitive material are preferable to obtain a transparent heat sensitive layer excellent in freshness-keeping property.

In particular, esters are more preferred from a view point of a stability of the color developer emulsion.

Specific examples of esters having a high boiling point include phosphates (e.g., triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates (e.g., ethyl abietate, benzyl abietate), dioctyl adipate, diethyl succinate, isodecyl succinate, dioctyl azelate, oxalates (e.g., dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the color developers.

In the present invention, organic solvents having boiling point lower than 150° C. can be added to the foregoing solvents.

Some of these organic solvents are ethyl acetate, isopropyl acetate, butyl acetate, methylene chloride and the like.

By only using the organic solvent having boiling point lower than 150° C. as the solvent to dissolve the color developer, an image density at recording can be remarkably heightened.

Water soluble high polymers to be contained as a protective colloid in an aqueous solution which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

A partially saponified polyvinyl alcohol, especially one having saponification value of 75–90% is the most desirable.

When the partially saponified polyvinyl alcohol is used for protective colloid, although a reason is not clear but a stability of a color developer containing emulsion is improved and as a result a transparency of a heat sensitive recording layer becomes quite excellent. In order to make an above mentioned advantage of the partially saponified polyvinyl alcohol the largest, it is desirable to use said polyvinyl alcohol when the emulsion is prepared but it is also possible to add said polyvinyl alcohol into the emulsion which has been prepared using other protective colloid than said polyvinyl alcohol.

Surface active agents to be contained additionally in the aqueous solution can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium dodecylbenzenesulfonate), sodium alkylsulfate, sodium dioctylsulfosuccinates, polyalkylene glycols (such as polyoxyethylene nonylphenyl, ether) and so on.

An emulsified dispersion of color developers to be used in the present invention can be prepared with ease by mixing an oil phase containing the color developers and an aqueous phase containing a protective colloid and a surface active agent with a general means for preparing a fine grain emulsion, such as a high-speed stirrer, an ultrasonic disperser or so on, to disperse the former phase into the latter phase.

To the emulsified dispersion thus obtained, melting point depressants for the color developers can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japanese Patent Application No. 244190/84.

These melting point depressants can be used in an amount of 0.1 to 2 parts by weight, preferably 0.5 to 1 part by weight, per 1 part by weight of color developer whose melting point is to be depressed. It is to be desired that the melting point depressant and the color developer, whose melting point can be depressed thereby, should be used in the same place. When they are added to separate places, a preferred addition amount of the melting point depressant is 1 to 3 times of that of the above-described one.

For the purpose of prevention of sticking to a thermal head, and improvement on writing quality, pigments such as silica, barium sulfate, titanium oxide, aluminium hydroxide, zinc oxide, calcium carbonate, etc., styrene beads, or fine particles of urea/melamine resin and so on can be added to the heat sensitive recording material of the present invention. In order to keep the transparency of the heat sensitive layer, it is to be desired that the above-described pigments and so on should be added to a protective layer which is provided on the heat sensitive layer in a conventional manner for the purpose of acquisition of keeping quality and stability of the heat sensitive recording material. Details of the protective layer are described in "Kami Pulp Gijutsu Times", pp. 2 to 4 (Sept. 1985).

In a heat sensitive layer of a heat sensitive recording material of the present invention, fillers are added in order to improve a film strength of the heat sensitive layer or to prevent sticking to a thermal head. These fillers should be those having a certain refractive index - namely, a ratio of (refractive index of color developer dissolved solution/refractive index of the filler) is 0.95–1.05—in order to prevent decrease of transparency of the heat sensitive layer.

Some of the fillers are inorganic fillers such as zinc oxide, calcium carbonate, barium sulfate, titanium oxide, lithopone, talc, agalmatolite, kaolin, aluminum hydroxide, amorphous silica and colloidal silica; organic pigments such as polystyrene, vinylacetate resin, polymethyl metacrylate, styrene-metacrylate copolymer and melamine-formaldehyde; metal salts such as zinc stearate, calcium stearate and aluminium stearate; and waxes such as paraffin wax, microcrystalline wax, carnauba wax, methylolstearoamide, polyethylene wax and silicone.

In order to prevent lowering transparency, particle sizes of these fillers should be less than 3 microns and those less than 1.5 microns are preferred.

These fillers can be used alone or in combination of two or more of them.

Total amount of fillers to be added is, generally, 0.1–100 wt % and particularly 10–50 wt % is preferred per weight of the heat sensitive layer.

In the present invention, by adding the fillers into the heat sensitive layer, a film strength of the heat sensitive layer is increased and an antiscratch property is improved. In spite of getting this advantageous, a trasnsparency of the heat sensitive layer is scarcely lowered, since light scattering in the heat sensitive layer is hardly occurred because not only a particle size of fillers are quite fine (less than 3 microns) but also a ratio of (refractive index of color developer dissolved solution/refractive index of the fillers) is 0.95–1.05.

Also, metal soap can be added for the purpose of prevention of the sticking phenomenon. They are used at a coverage of 0.2 to 7 g/m$^2$.

The heat sensitive recording material can be formed using a coating technique with the aid of an appropriate binder.

As for the binder, a polyvinyl alcohol, a methyl cellulose, a carboxymethyl cellulose, a hydroxypropyl cellulose, a gum arabic, a gelatin, a polyvinyl pyrrolidone, a casein, a styrene-butadiene latex, an acrylonitrile-butadiene latex, a polyvinyl acetate, a polyacrylate, various kinds of emulsions such as an ethylene-vinyl acetate copolymer emulsion, and so on, can be employed. An amount of the binder used is 0.5 to 5 g per square meter on a solids basis.

In addition to the above-described ingredients, an acid stabilizer, such as citric acid, tartaric acid, oxalic acid, boric acid, phosphoric acid, pyrophosphoric acid, etc., can be added to the heat sensitive material of the present invention.

The heat sensitive recording material is produced by providing a heat sensitive layer on a support, such as paper, a synthetic resin film, etc., coating and drying a coating composition, in which microcapsules enclosing a color former therein and a dispersion containing at least a color developer in an emulsified condition are contained as main components, and further a binder and other additives are incorporated, according to a conventional coating method. A coverage of the heat sensitive layer is controlled to 2.5 to 25 g/m$^2$ on a solids basis. It is a surprise to find that thus prepared heat sensitive layer has quite excellent transparency, though the reason for its transparency is not elucidated.

The transparency can be estimated by measuring Haze (%) using HTR meter (integrating - sphere photometer) manufactured by Nippon Seimitus Kogyo K. K. However, for the transparency of a heat sensitive layer of a test sample is remarkably affected by light-scattering caused by minute roughness of a surface of the heat sensitive layer. Therefore, a transparent adhesive tape is stuck on the surface of the heat sensitive layer to prevent the light scattering then measurement is carried out to estimate an intrinsic transparency of the heat sensitive layer.

As for the paper to be used as a support, neutralized paper which is sized with a neutral sizing agent like an alkylketene dimer and shows pH 6–9 upon hot extraction is employed to advantage in the respect of long-storage.

In order to prevent the penetration of a coating composition into paper, and in order to effect a close contact between a heat recording head and a heat sensitive recording layer, paper described in Japanese Patent Application (OPI) No. 116687/82, which is characterized by Stökigt sizing degree/(meter basis weight)$^2 \geqq 3 \times 10^{-3}$ and Bekk smoothness of 90 seconds or more, is used to advantage.

In addition, paper having optical surface roughness of 8 microns or less and a thickness of 40 to 75 microns, as described in Japanese Patent Application (OPI) No. 136492/83; paper having a density of 0.9 g/cm$^3$ or less and optical contact rate of 15% or more, as described in Japanese Patent Application (OPI) No. 69097/83; paper which is prepared from pulp having received a beating treatment till its freeness has come to 400 cc or more on a basis of Canadian Standard Freeness (JIS P8121) to prevent permeation of a coating composition thereinto, as described in Japanese Patent Application (OPI) No. 69097/83; raw paper made with a Yankee paper machine, which is to be coated with a coating composition on the glossy side and thereby, improvements on developed color density and resolution are intended, as described in Japanese Patent Application (OPI) No. 65695/83; raw paper which has received a corona discharge processing and thereby, its coating aptitude has been enhanced, as described in Japanese Patent Application (OPI) No. 35985/84; and so on can be employed in the present invention, and can bring about good results. In addition to the above-described papers, all supports which have so far been used for general heat sensitive recording papers can be employed as the support of the present invention.

If a transparent support is used, an image recorded in the heat sensitive material can be observed from one side as transmitted image or reflected image. In the latter case, the image is not clear since the back side is seen through the background area. Therefore, a white pigment may be added to a heat sensitive layer, or a layer containing a white pigment may be additionally provided. In both cases, it is effective to add a white pigment to the outermost layer located on the opposite side of the recorded-image observation. Suitable example of white pigments include talc, calcium carbonate, calcium sulfate, magnesium carbonate, magnesium hydroxide, alumina, synthetic silica, titanium oxide, barium sulfate, kaolin, calcium silicate, urea resin, and so on.

A preferred size of particles dispersed is 10 microns or less.

The term transparent support as used herein is intended to include film of polyesters such as polyethylene terephthalate, polybutylene terephthalate and the like, cellulose derivative films like a cellulose triacetate film, polyolefin films such as a polystyrene film, a polypropylene film, a polyethylene film and the like and so on. These films may be used, independently or in a laminated form.

A preferred thickness of such a transparent support is within the range of 20 to 200 microns, particularly 50 to 100 microns.

A subbing layer which can be employed in the present invention functions so as to heighten the adhesiveness between the transparent support and the heat sensitive layer. As a material for forming the subbing layer, mention may be made of gelatin, synthetic high polymer latexes, nitrocellulose, and so on. A preferred coverage of the subbing layer ranges from 0.1 to 2.0 g/m$^2$, particularly from 0.2 to 1.0 g/m$^2$. When the coverage is below 0.1 g/m$^2$, adhesion of the heat sensitive layer to the support is insufficient, whereas even when it is increased beyond 2.0 g/m$^2$, the adhesion power attains saturation to bring about only increase in cost.

It is to be desired that the subbing layer should be hardened with a hardener because it sometimes swells in water contained in a solution coated thereon to prepare the heat sensitive layer which causes deterioration of image formed in the heat sensitive layer.

As examples of hardeners which can be used in the present invention, mention may be made of:

(1) active vinyl-containing compounds, such as divinylsulfone, N,N'-ethylenebis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, and the like, (2) active halogen-containing compounds, such as sodium salt of 2,4-dichloro-6-hydroxy-s-triazine, 2,4-dichloro-6-methoxy-s-triazine, sodium salt of 2,4-dichloro-6-(4-sulfoanilino)-s-triazine, 2,4-dichloro-6-(2-sulfoethylamino)-s-triazine, N,N'-bis(2-chloroethylcarbamyl)piperazine, and the like, (3) epoxy compounds, such as bis(2,3-epoxypropyl)-methylpropylammonium-p-toluenesulfonate, 1,4-bis(2',3'-epoxypropyloxy)-butane, 1,3,5-triglycidylisocyanurate, 1,3-diglycidyl-5-(α-acetoxy-β-oxypropyl)isocyanurate, and the like.

(4) ethyleneimino compounds, such as 2,4,6-triethylene-s-triazine, 1,6,-hexamethylene-N,N'-bisethyleneurea, bis-β-ethyleneiminoethylthioether, and the like, (5) methanesulfonate compounds, such as 1,2-di(methanesulfonoxy)ethane, 1,4-di(methanesulfonoxy)butane, 1,5-di(methanesulfonoxy)pentane, and the like, (6) carbodiimide compounds, such as dicyclohexylcarbodimide, 1-cyclohexyl-3-(3-trimethylaminopropyl)-carbodiimido-p-triethanesulfonate, 1-ethyl-3-(3-dimethylaminopropyl)carbodiimide hydrochloride, and the like, (7) iso-oxazole compounds, such as 2,5-dimethylisooxazole perchlorate, 2-ethyl-5-phenyl-iso-oxazole-3-sulfonate, 5,5'-(p-phenylene)bis-iso-oxazole, and the like, (8) inorganic compounds, such as chrome alum, bolic acid, zirconium salt, chromium acetate, and the like, (9) dehydrating condensation type peptide reagents such as N-carboethoxy-2-isopropoxy-1,2-dihydroquinoline, N-(1-morpholinocarboxy)-4-methylpyridinium chloride and the like, and active ester compounds such as N,N'-adipolyl-dioxy-disuccinimide, N,N'-terephthaloyl-dioxydisuccinimide and the like, and

(10) isocyanates, such as toluene-2,4-diisocyanate, 1,6-hexamethylenediisocyanate and the like.

(11) aldehydes such as glutaric aldehyde, glyoxal, dimethoxy urea, 2,3-dihydroxy-1,4-dioxane and the like.

Among these hardeners, especially aldehydes such as the glutaric aldehyde, the 2,3-dihydroxy-1,4-dioxane etc. and the boric acid are preferable.

Such a hardner is added in a proportion ranging from 0.20 to 3.0 wt % to the weight of the materials to constitute the subbing layer. A proper amount to be added can be selected depending on the coating method, the intended degree of hardening.

When the addition amount of a hardener is below 0.20 wt %, sufficient hardening can not be achieved however long the time elapsed is, and therefore the subbing layer swells upon coating of the heat sensitive layer, whereas when the hardener is added in a concentration higher than 3.0 wt % the hardening proceeds too fast, and therefore the adhesiveness between the subbing layer and the support is lowered to result in peeling off the subbing layer from the support in the form of a film.

According to the hardener used, the pH of a coating solution for the subbing layer can be rendered alkaline by the addition of sodium hydroxide or the like, or acidic by the addition of citric acid or the like, if needed.

Further, a defoaming agent can be added in order to eliminate foams generated upon coating, and a surface active agent can also be added in order to level the surface of the coating solution in a good condition to result in prevention of coating streaks.

Furthermore, an antistatic agent can be added, if needed.

Before coating of the subbing layer, the surface of a support is preferably subjected to an activation processing according to known methods. As a method for the activation processing, mention may be made of an etching processing with an acid, a flame processing with a gas burner, a corona processing, glow discharge processing, and so on. From the viewpoint of cost or simplicity, corona discharge processing described in U.S. Pat. Nos. 2,715,075, 2,846,727, 3,549,406 and 3,590,107, and so on are employed to the greatest advantage.

Coating compositions prepared in accordance with the present invention are coated using a dip coating process, an air knife coating process, a curtain coating process, a roller coating process, a doctor knife coating process, a wire bar coating process, a slide coating process, a gravure caoting process, an extrusion coating process using a hopper described in U.S. Pat. No. 2,681,294, or so on. Two or more of different coating compositions can be coated simultaneously, if desired, using methods described in U.S. Pat. Nos. 2,761,791, 3,508,947, 2,941,898, and 3,526,528. Yuji Harasaki, Coating Kogaku (which means "Coating Engineering"), p.253, Asakura Shoten (1973), and so on. An appropiate method can be chosen from the above-cited ones depending on intended coverage, coating speed, and so on.

In the coating compositions of the present invention, it is allowed to add properly a pigment dispersing agents, a viscosity increasing agent, a fluidity modifying agent, a defoaming agent, a foam inhibitor, a mold lubricant, a coloring agent and so on so far as they have no adverse influences upon characteristics.

The heat sensitive recording material of the present invention can be designed in various embodiments such as OHP and so on according to a utility or object to use. As for other embodiments than OHP, a heat sensitive recording material comprised of a support having more than two heat sensitive layers (each coloring of them is different each other) on both side of the support directly or indirectly can be listed—that is, a subbing layer may be coated beneath the first heat sensitive layer and a protective layer may be prepared before the second heat sensitive layer. Moreover, the substantially transparent heat sensitive layer described in this specification can be provided on a conventional photo-, heat- or photo and heat sensitive layer so that the coloring of each layer comes to different each other.

EXAMPLES

The present invention is illustrated in greater detail by reference to the following examples. However, the present invention should not be construed as being limited to these examples.

EXAMPLE 1

Preparation of Capsule Solution 14 g of Crystal Violet lactone (leuco dye), 60 g of Takenate D 110N (Trade name of capsule wall material, produced by Takeda Yakuhin K. K.) and 2 g of Sumisoap 200 (Trade name of ultraviolet absorbent, produced by Sumitomo Kagaku K. K.) were added to a mixed solvent consisting of 55 g of 1-phenyl-1-xylylethane and 55 g of methylene chloride, and dissolved therein. The solution of the above-described leuco dye was mixed with an aqueous solution constitued with 100 g of a 8% water solution of polyvinylalcohol, 40 g of water and 1.4 g of a 2% water solution of sodium dioctylsulfosuccinate (dispersant), and emulsified with stirring at 10,000 r.p.m. for 5 minutes using Ace Homogenizer made by Nippon Seiki K. K. Then, the resulting emulsion was diluted with 150 g of water, and allowed to stand at 40° C. for 3 hours to conduct the microencapsulation reaction therein. Thus, a solution containing microcapsules having a size of 0.7 micron was obtained.

Preparation of Color Developer-emulsified Dispersion

The color developers (a)8 g, (b)4 g and (c)30 g represented by the structural formulae illustrated below, respectively, were added to a solvent mixture of 210 g of 1-phenyl-1-xylylethane and 30 g of ethyl acetate, and dissolved thereinto. Thus obtained solution was mixed with 100 g of 8% water solution of polyvinylalcohol (PVA 205 manufactured by Kurare K. K.; saponification value is 87% to 89%), 150 g of water and 0.5 g of sodium dodecylbenzensulfonate, and emulsified with stirring at 10,000 r.p.m. for 5 minutes at ordinary temperature using Ace Homogenizer made by Nippon Seiki K. K. to prepare an emulsified dispersion having a grain size of 0.5 micron.

Color Developer (a) Zinc Salt of

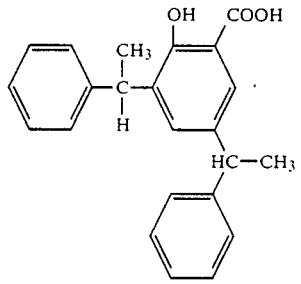

Color Developer (b)

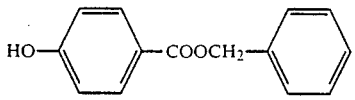

Color Developer (c)

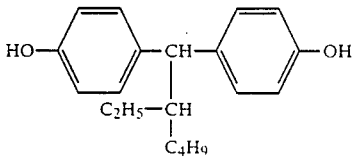

Production of Heat Sensitive Material

A 5.0 g portion of the foregoing capsule solution, a 10.0 g portion of the foregoing color developer-emulsified dispersion and 5.0 g of water were mixed with stirring. Stability of thus obtained solution after 1 hour was confirmed. The solution kept for 1 hour after it was prepared was coated on a 70 micron transparent polyethylene terephthalate (PET) film support at a coverage of 15 g/m$^2$ on a solids basis, and dried.

The result of measurement of Haze (%) on above prepared film of transparency using HTR meter (integrating-sphere photometer) manufactured by Nippon Seimitsu Kogyo K. K. was 8%, and it was proved that the heat sensitive recording material thus obtained had an excellent transparency.

EXAMPLE 2

A test sample was prepared in the same manner as in Example 1 except using a polyvinylalcohol (PVA 217 E: manufactured by Kurare K. K.: saponification value is 87% to 89%) in place of the polyvinylalcohol (PVA 205: manufactured by Kurare K. K. saponification value is 87%–89%,) which had been employed when the color developer-emulsified dispersion had been prepared. As a result of test carried out in the same manner as in Example 1, it was confirmed that the stability of the coating solution and transparency of coated film were excellent as Example 1.

EXAMPLE 3

A test sample was prepared in the same manner as Example 1 except using a polyvinyl alcohol (PVA 420: manufactured by Kurare K. K.: saponification value is 79.5% to 83.5%) in place of the polyvinyl alcohol (PVA 205: manufactured by Kurare K. K.: saponification value is 87% to 89%,) which had been employed when the color developer-emulsified dispersion had been prepared. As a result of test carried out in the same manner as in Example 1, it was confirmed that the stability of the coating solution and transparency of coated film were excellent as Example 1.

COMPARATIVE EXAMPLE 1

A test sample was prepared in the same manner as in Example 1 except using a polyacryl amide in place of the polyvinylalcohol (PVA 205 manufactured by Kurare K. K.: saponification value is 87 to 89%,) which had been employed when the color developer emulsified dispersion had been prepared.

As a result of test, it was confirmed that the coating solution was so unstable that compositions were separated. Even when the coating solution was coated on the film before the separation phenomenon had been observed the coated film converted into opaque film in a dry process.

COMPARATIVE EXAMPLES 2-5

A test sample was prepared in the same manner as in Comparative Example 1 except (1)maleic anhydride/styrene copolymer (Comparative Example 2),(2) maleic anhydride/isobutylene copolymer (Comparative Example 3), (3)Completely saponified polyvinyl alcohol (PVA 105 manufactured by Kurare K. K.: saponification value is 98 to 99%) (Comparative Example 4) and (4) completely saponified polyvinyl alcohol (PVA 117 manufactured by Kurare K. K.: saponification value is 98 to 99%,)(Comparative Example 5) were used in place of polyacryl amide, respectively.

As a result of test carried out in the same manner as in Comparative Example 1, it was confirmed that each result is almost same to that of Comparative Example 1.

These results prove that the partially saponified polyvinyl alcohol is remarkably advantageous for dispersion stability of the color developer emulsified dispersion.

EXAMPLE 4

On a heat sensitive recording material obtained in Example 1, 2 micron thick protective layer having the following composition was further provided to produce a transparent heat sensitive film.

Composition of Protective Layer

| | |
|---|---|
| 10% Polyvinyl Alcohol PVA 117 (manufactured by Kurare K.K.) | 20 g |
| Water | 30 g |
| 2% sodium Dioctylsulfosuccinate | 0.3 g |
| Kaolin Dispersion (prepared by dispersing 3 g of polyvinyl alcohol, 100 g of water and 35 g of kaolin with a ball mill) | 3 g |
| Hidolin Z-7 (Trade name of product of Chukyo Yushi K.K. ) | 0.5 g |

Printing was carried out on thus obtained heat sensitive material using Mitsubishi Melfas 600 (Trade name of facsimile machine manufactured by Mitsubishi Denki K. K. (GIII mode)) to develop a blue image. The density of the developed image measured by a McBeath transmission densitometer was 0.7. The obtained image was able to submitted to projection with an overhead projector as it was.

In order to estimate stability of the coated film of thus obtained heat sensitive material, the heat sensitive material was left for 3 days in a condition of high temperature and high humidity (40° C., 90% of relative humidity).

As a result of this forced test no deposition of the color developer was observed, thus the stability of the heat sensitive recording material of the present invention was confirmed.

EXAMPLE 5

A heat sensitive recording material was obtained in the same manner as in Example 4 except using 12 g of color developer (a) in place of 8 g of it. As a result of tests carried out in the same manner as in Example 4, storage stability was as good as that of Example 4, however, image density was lowered to 0.54. From the results, it was confirmed that when an amount of zinc salt is increased, the storage stability is improved but the image density is lowered.

EXAMPLE 6

A heat sensitive recording material was obtained in the same manner as in Example 4 except the following color developer was used in place of color developer (a). As a result of tests carried out in the same manner as in Example 4, high image density of 0.71 was obtained and the storage stability was as excellent as Example 1.

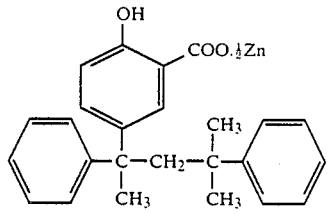

EXAMPLE 7

A heat sensitive recording material was obtained in the same manner as in Example 4 except the following color developer was used in place of color developer (a). As a result of tests carried out in the same manner as in Example 4, high image density of 0.65 was obtained and the storage stability was as excellent as Example 4.

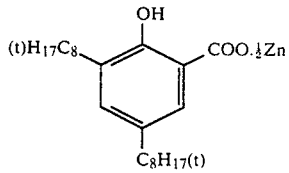

COMPARATIVE EXAMPLE 6

A heat sensitive recording material was obtained in the same manner as in Example 4 except omitting all amounts of color developer (a).

As a result of the same tests carried out in Example 4, an image density was high enough as 0.84, however, remarkable deposition of color developer through forced test was occurred and it was confirmed that the heat sensitive layer became opaque and that the storage property was bad.

COMPARATIVE EXAMPLE 7

A heat sensitive recording material was obtained in the same manner as in Example 4 except using 1.5 g (4.2 wt %) of color developer (a) in place of 8 g of the same and the same tests as in Example 4 were carried out.

As a result of tests, a small amount of deposition of color developer was observed after the forced test, though an image density was 0.77 which was high enough. These facts prove that if an addition amount of metal salt of salicylic acid is less than 5 wt % per total weight of color developers, sufficient storage stability can not be obtained.

EXAMPLE 8

A heat sensitive recording material was obtained in the same manner as in Example 4 except 34 g of the following color developer was used in place of color developers (b) and (c) then the same tests as in Example 4 were carried out.

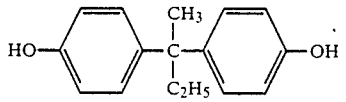

In this case, an image density was 0.82 which was high enough, moreover no deposition of color developers were observed after the forced test, thus the storage stability was excellent.

EXAMPLE 9

A heat sensitive recording material was obtained in the same manner as in Example 4 except 34 g of the following color developer was used in place of color developers (b) and (c) then the same tests as in Example 4 were carried out.

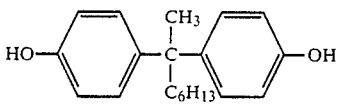

In this case, image density was 0.7, no deposition of color developers were observed after the forced test and the storage stability was excellent.

EXAMPLE 10

A heat sensitive recording material was obtained in the same manner as in Example 4 except 34 g of the following color developer was used in place of color developers (b) and (c) then the same tests as in Example 4 were carried out.

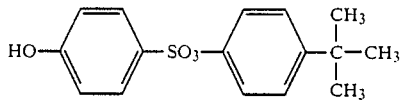

In this case, image density was 0.65, no deposition of color developers were observed after the forced test and the storage stability was excellent.

EXAMPLE 11

A heat sensitive recording material was obtained in the same manner as in Example 4 except 8 g of the color developer (b) and 26 g of the following color developer were used in place of 4 g of the color developer (b) and 30 g of the color developer (c), then the same tests as in Example 4 were carried out. In this case also, high image density as 0.76 was obtained, no deposition of the color developers were observed after the forced test and storage stability was excellent.

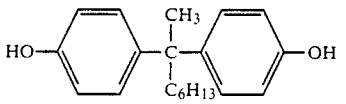

COMPARATIVE EXAMPLES 8-11

Comparative Examples 8-11 were carried out by omitting the color developer (a) from the Examples 8-11. Image densities and results of the forced test were shown in Table 1.

TABLE 1

| NO. of comparative Example | Image Density | Forced Test (quantity of deposition) |
|---|---|---|
| 8 | 0.91 | great(opaque) |
| 9 | 0.76 | medium-great(opaque) |
| 10 | 0.72 | a little(opaque) |
| 11 | 0.81 | great(opaque) |

From the results of Examples 4-11 and Comparative Examples 4-11 it is proved that the storage stability of transparent heat sensitive recording material can be improved by an addition of metal salt of salicylic acid into free phenolic color developer.

EXAMPLE 12

Preparation of Capsule Solution 12 g of leuco dye represented by the structural formula illustrated below was added to a solvent mixture of 12 g of diphenyl-xylylethane and 15 g of ethyl acetate at 60° C. and dissolved thereinto. The obtained solution was cooled at 30° C., and 16 g of Takenate D 110N (Trade name of capsule wall material, produced by Takeda Yakuhin K. K.) was added thereinto. Thus obtained solution was mixed with 45 g of 8% aqueous solution of polyvinyl alcohol (PVA 217E; manufactured by Kurare Co. Ltd.), and 33 g of water, then emulsified by stirring at 10,000 r.p.m. for 5 minutes using an Ace Homogenizer made by Nippon Seiki K. K. Then, the resulting emulsion was diluted with 120 g of water and allowed to stand at 40° C. for 3 hours to conduct the microcapsulation reaction therein. Thus a solution containing microcapsules having a size of 0.7 micron was obtained.

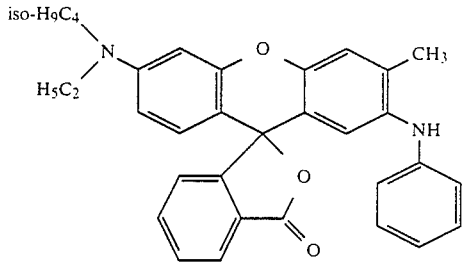

Preparation of Color Developer-emulsified Dispersion

The color developers (a) 8 g, (b) 4 g and (c) 30 g, which were same to those used in Example 1, were dissolved in a mixed solvent of 8 g of 1-phenyl-1-xylylethane and 30 g of ethyl acetate. Thus obtained solution of the color developers was mixed with aqueous solution consisting of 100 g of 8% aqueous solution of polyvinyl alcohol, 150 g of water and 0.5 g of sodium dodecylbenzensulfonate, then emulsified by stirring at 10,000 r.p.m. for 5 minutes at ordinary temperature using Ace Homogenizer made by Nippon Seiki K. K. to prepare an emulsified dispersion having a grain size of 0.5 micron.

Production of Heat Sensitive Material

A 5.0 g portion of the foregoing capsule solution, 10.0 g portion of the foregoing color developer-emulsified dispersion and 5.0 g of water were mixed with stirring.

Thus obtained solution was coated on a 70 micron thick transparent polyethylene terephthalate (PET) film support at a coverage of 10 g/m$^2$ on a solids basis, and dried. 2 micron thick protective layer having the following composition was further provided to produce a transparent heat sensitive film.

Composition of Protective Layer

| | |
|---|---|
| Modified Polyvinylalcohol with silicon (PVA R2105: manufactured by Kurare K.K.) | 1 weight part (solid basis) |
| Colloidal silica (Snowtex 30: manufactured by Nissan Kagaku K.K.) | 1.5 weight part (solid basis) |
| Zinc stearate (Hidolin Z-7: manufactured by Chukyo Yushi K.K.) | 0.02 weight part (solid basis) |
| Paraffin wax (Cerosol 428: manufactured by Chukyo Yushi K.K.) | 0.2 weight part (solid basis) |

Printing was carried out on the obtained heat sensitive film using GIII mode facsimile obtained in the market. As a result of measurement of color density with McBeath transmission densitometer quite high density of 1.20 was obtained.

EXAMPLE 13

The following leuco dye was used in place of the leuco dye used in Example 12, however capsulation was not possible since deposition of color developer was occurred in a cooling process of solution, obtained by dissolving the color developer into oil, to 30° C. Therefore, a transparent heat sensitive film was prepared in the same manner as in Example 12, except an amount of the following leuco dye was decreased from 12 g to 10.5 g.

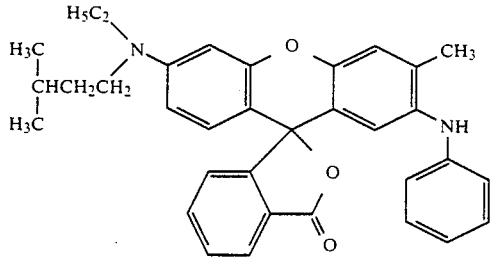

Color density was measured in the same manner as in Example 12. The result was satisfactory since the color density was 1.05.

EXAMPLE 14

A deposition of color developer just as one observed in Example 13 was occurred when the following leuco dye was used in place of the leuco dye used in Example 12. Therefore, a heat sensitive film was prepared in the same manner as in Example 12 except an amount of the following leuco dye was decreased to 10 g.

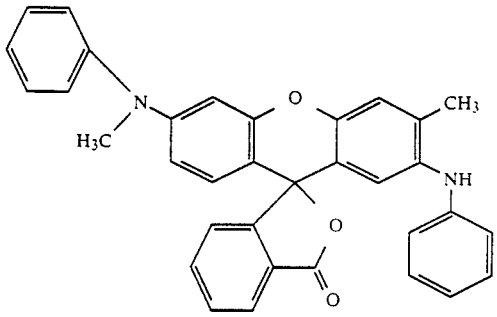

Color density was measured in the same manner as in Example 12. The result was satisfactory since the color density was 1.00.

COMPARATIVE EXAMPLE 12

A deposition of color developer just as one observed in Example 13 was occurred when the following leuco dye was used in place of the leuco dye used in Example 12. Therefore, a heat sensitive film was prepared in the same manner as in Example 12 except an amount of the following leuco dye was decreased to 6 g, and color density was measured in the same manner as in Example 12.

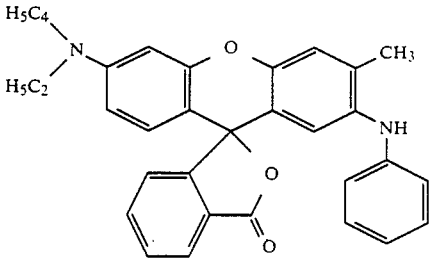

The color density obtained in this case was 0.80 and it was proved that the color density of the heat sensitive film thus obtained was lower than those of heat sensitive films of Examples 12–14.

EXAMPLES 15–18 AND COMPARATIVE EXAMPLES 13–15

A 5.0 g portion of the capsule solution, a 10.0 g portion of the color developer-emulsified dispersion, both are prepared in Example 12, and 4.5 g of 20% dispersed solution of filler shown in Table 1 and 5.0 g of water were mixed with stirring, then obtained solution was coated on a 75 micron thick transparent polyethylene terephthalate (PET) film support at a coverage of 10 g/m$^2$ on a solids basis, and dried.

TABLE 2

| Filler | | Particle Diameter (micron) | Refractive Index | R |
|---|---|---|---|---|
| Example 15 | Copolymer Particle (Styrene/Methacrylate = 1/1) | 1.0 | 1.54 | 0.98 |
| Example 16 | Kaoln (Geogia Kaobrite) | 2.5 | 1.55 – 1.57 | 0.99 – 1.0 |
| Example 17 | Styrene Particle | 2.0 | 1.59 | 1.01 |
| Example 18 | Polyethylene Particle | 1.0 | 1.51 | 0.96 |
| Comparative Example | | | | |

TABLE 2-continued

| Filler | | Particle Diameter (micron) | Refractive Index | R |
|---|---|---|---|---|
| 13 | Copolymer Particle (Styrene/Methacrylate = 1/1) | 5.0 | 1.54 | 0.98 |
| 14 | Polymethylmethacrylate Particle | 1.0 | 1.48 | 0.94 |
| 15 | None | — | — | — |

R: A ratio of refractive index of filler against that of color developer solution A protective layer of the following composition was coated on a heat sensitive layer of the following composition at a coverage of 3 g/m$^2$ on a solids basis, and dried.

| | |
|---|---|
| Modified Polyvinylalcohol with silicon (PVA R 2105: manufactured by Kurare K.K.) | 2 weight part (solid basis) |
| Colloidal silica (Snowtex 30: manufactured by Nissan Kagaku K.K.) | 3 weight part (solid basis) |
| Paraffin wax emusion (Cerosol 428: manufactured by Chukyo Ushi K.K.) | 1 weight part (solid basis) |
| Zinc stearate emulsion (Hidolin Z-7: manufactured by Chukyo Yushi K.K.) | 0.1 weight part (solid basis) |

The tranparency of thus obtained heat sensitive recording material was measured using intergration-sphere photometer (Haze Meter). Then, film strength was estimated by scratching a surface of the heat sensitive recording material with nails. The results were shown in Table 3.

TABLE 3

| | Haze degree (%) | Film strength |
|---|---|---|
| Example | | |
| 15 | 8 | hardly scratched |
| 16 | 10 | hardly scratched |
| 17 | 11 | hardly scratched |
| 18 | 12 | hardly scratched |
| Comparative Example | | |
| 13 | 23 | hardly scratched |
| 14 | 24 | hardly scratched |
| 15 | 8 | easily scratched |

The results of Table 3 prove that the heat sensitive layers of Examples 15–18 are excellent in both transparency and antiscratch property.

EXAMPLES 19–20 AND COMPARATIVE EXAMPLES 16–17

Preparation of Color Developer-emulsified Dispersion

The color developers (a) 7 g, (b) 7 g, (c) 5 g, (d) 7 g and (e) 4 g represented by the structural formulae illustrated below were added to 38 g of ethyl acetate, and dissolved thereinto. Thus obtained solution of the color developers was mixed with 100 g of 8% water solution of polyvinyl alcohol, 150 g of water and 0.5 g of sodium dodecylbenzensulfonate, and emulsified with stirring at 10,000 r.p.m. for 5 minutes at ordinary temperature using Ace Homogenizer made by Nippon Seiki K. K. to prepare an emulsified dispersion having a grain size of 0.5 micron.

Color Developer (a)

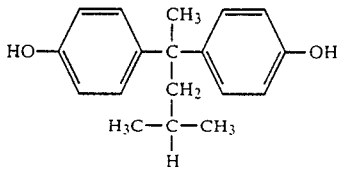

Color Developer (b)

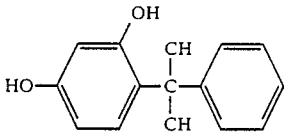

Color Developer (c)

Zinc Salt of

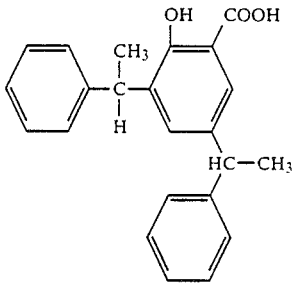

Color Developer (d)

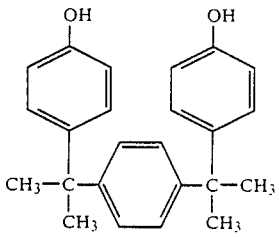

Color Developer (e)

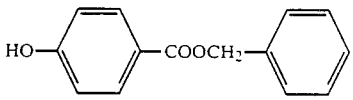

Production of Heat Sensitive Material

A 5.0 g portion of the foregoing capsule solution, a 10.0 g portion of the foregoing color developer-emulsified dispersion and 5.0 g of water were mixed with stirring, coated on a 75 micron thick transparent polyethylene terephthalate (PET) film support at a coverage of 10 g/m$^2$ on a solids basis, and dried. Thus a heat sensitive recording material of Example 19 was obtained.

A heat sensitive recording material of Example 20 was obtained in a same manner as in Example 19 except using 38 g of n-butylacetate in place of 38 g ethylacetate, similarly a heat sensitive recording material of Comparative Example 16 by using 30 g of ethylacetate and 8 g of 1-phenyl-1-xylylethane in place of 38 g ethylacetate, and a heat sensitive recording material of Comparative Example 17 was obtained by using 30 g of ethylacetate and 8 g of diethylmaleate in place of 38 g of ethylacetate.

On the each heat sensitive recording material of Example 19, Example 20, Comparative Example 16 and Comparative Example 17, heat recording was carried out by Mitsubishi Melfax 600 (G III mode: goods manufactured by Mitsubishi Denki K. K.) and image density of blue image was measured by McBeath transmission densitometer.

Result were shown in Table 4.

TABLE 4

| Sample | Transmission Density |
|---|---|
| Example 19 | 0.85 |
| Example 20 | 0.86 |
| Comparative Example 16 | 0.70 |
| Comparative Example 17 | 0.68 |

The results of Table 4 prove that the image density colored by heat recording can be heightened by only using organic solvent having boiling point lower than 150° C. when a color developer emulsified dispersion had been prepared.

What is claimed is:

1. A heat sensitive recording material which is comprised of a support having thereon a transparent heat sensitive layer comprising a binder, a color developer, an organic solvent for a color developer slightly soluble or insoluble in water, a water soluble polymer which functions as a protective colloid for the color developer and a microcapsule containing an electron donating dye precursor, said water soluble polymer comprising a partially saponified polyvinyl alcohol, wherein said transparent heat sensitive layer is prepared by coating a solution obtained by mixing the microcapsule containing the electron donating dye precursor with an emulsion prepared by dispersing the color developer dissolved in the organic solvent into an aqueous solution containing the water soluble polymer.

2. The heat sensitive recording material as claimed in claim 1, wherein a saponification value of said partially saponified polyvinyl alcohol is 75–90%.

3. The heat sensitive recording material as claimed in claim 2, wherein a partially saponified polyvinyl alcohol is used alone as said water soluble polymer.

4. The heat sensitive recording material as claimed in claim 1, wherein both of free phenolic compound and metal salts of salicylic acid derivatives are used as said color developer.

5. The heat sensitive recording material as claimed in claim 4, wherein said metal salts of salicylic acid derivatives are those of zinc salts.

6. The heat sensitive recording material as claimed in claim 1, wherein said electron donating dye precursor is represented by the following general formula;

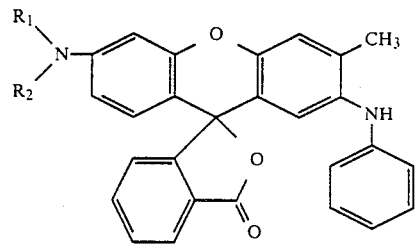

wherein $R_1$ is an alkyl group of $C_1$–$C_8$, $R_2$ is an alkyl group or alkoxyalkyl group of $C_4$–$C_8$, or tetrahydrofurfuryl group but $R_1$ is not equal to $R_2$.

7. The heat sensitive recording material as claimed in any proceding claim wherein a boiling point of said organic solvent is lower than 150° C.

8. The heat sensitive recording material as claimed in anyone of claims 1 to 6, wherein fillers of which average diameter is less than 3 microns and a ratio of (refractive index of said organic solvent in which the color developer has been dissolved/refractive index of the filler) is 0.95–1.05 are further contained in the heat sensitive layer.

9. The heat sensitive recording material as claimed in claim 8, wherein a protective layer is further provided on the transparent heat sensitive layer.

* * * * *